US009388021B2

(12) United States Patent
Franke

(10) Patent No.: US 9,388,021 B2
(45) Date of Patent: Jul. 12, 2016

(54) ATTACHMENT MEANS AND APPARATUS COMPRISING SUCH AN ATTACHMENT MEANS FOR LIFTING HEAVY LOADS

(75) Inventor: Boris Franke, Heinsberg (DE)

(73) Assignee: Spanset Inter AG, Wollerau (DE)

( * ) Notice: Subject to any disclaimer, the term of this patent is extended or adjusted under 35 U.S.C. 154(b) by 0 days.

(21) Appl. No.: 13/884,421

(22) PCT Filed: Nov. 10, 2011

(86) PCT No.: PCT/EP2011/069858

§ 371 (c)(1),
(2), (4) Date: Jul. 18, 2013

(87) PCT Pub. No.: WO2012/062865

PCT Pub. Date: May 18, 2012

(65) Prior Publication Data

US 2013/0285400 A1 Oct. 31, 2013

(30) Foreign Application Priority Data

Nov. 10, 2010 (DE) ..... 10 2010 060 475

(51) Int. Cl.
*B66C 1/12* (2006.01)
*B66C 1/18* (2006.01)

(52) U.S. Cl.
CPC .... *B66C 1/18* (2013.01); *B66C 1/12* (2013.01)

(58) Field of Classification Search
CPC ..... B66C 1/12; B66C 1/18; B66C 1/22; B66C 1/34; F16G 11/14
USPC ..... 294/74, 82.11, 24
See application file for complete search history.

(56) References Cited

U.S. PATENT DOCUMENTS

| | | | | |
|---|---|---|---|---|
| 1,498,153 | A * | 6/1924 | Cull | 414/756 |
| 2,213,718 | A | 9/1940 | Reed et al. | |
| 3,778,095 | A * | 12/1973 | Carr | 294/74 |
| 3,934,918 | A | 1/1976 | Kress et al. | |
| 3,941,412 | A * | 3/1976 | Carpenter | 294/74 |
| 4,066,287 | A * | 1/1978 | Rowley | 294/74 |
| 5,842,443 | A | 12/1998 | Steinfort | |
| 5,887,923 | A * | 3/1999 | Gardner, III | 294/81.55 |
| 6,719,341 | B2 * | 4/2004 | Gotz et al. | 294/82.11 |
| 6,913,301 | B2 * | 7/2005 | Gotz et al. | 294/74 |
| 2003/0132183 | A1 | 7/2003 | Gotz et al. | |
| 2004/0031096 | A1 * | 2/2004 | Liljedahl | 5/89.1 |
| 2004/0120798 | A1 | 6/2004 | Davis et al. | |
| 2013/0154290 | A1 * | 6/2013 | Betzler et al. | 294/82.11 |

FOREIGN PATENT DOCUMENTS

| | | |
|---|---|---|
| FR | 1156752 | 5/1958 |
| JP | 50011256 | 2/1975 |

* cited by examiner

*Primary Examiner* — Gabriela Puig
(74) *Attorney, Agent, or Firm* — The Webb Law Firm

(57) ABSTRACT

Disclosed embodiments relate to an attachment and an apparatus for lifting heavy loads by a lifting device in the form of a sling or strap. The attachment can be produced inexpensively and has a sufficient load bearing capacity with a low material requirement. The attachment comprises a contact part, which has a contact section with a length, measured in the longitudinal direction of the attachment, which corresponds to at least the width of the lifting device, the contact section having a contact surface on which, during practical use, the lifting device rests, and two attachment sections of which in each case one is integrally formed on one of the ends of the contact section and which are provided for attaching a hoist for coupling the attachment to a lifting apparatus.

11 Claims, 2 Drawing Sheets

ATTACHMENT MEANS AND APPARATUS COMPRISING SUCH AN ATTACHMENT MEANS FOR LIFTING HEAVY LOADS

BACKGROUND OF THE INVENTION

1. Field of the Invention

The present invention relates to an attachment means and an apparatus comprising such an attachment means for lifting heavy loads by means of a lifting means in the form of a sling or strap.

2. Description of Prior Art

Attachment means and apparatuses of this type are required, for example, when laying pipelines or workpieces of a comparable large size. Pipelines are usually made up of individual pipe sections and are generally laid in a channel or trench. Prior to laying the pipe sections are welded together so they can then be lifted into the prepared channel or trench. Other applications are, for example, large pipe-shaped components of wind power stations.

In order to minimize the stress on the components, a wide hoisting sling or strap is placed around the respective component generally at a plurality of coupling points, said hoisting sling or strap is then hung onto the hook of a crane by means of an attachment means. The typically triangular or trapezoidal attachment means generally have a slit which runs parallel to the base of the attachment means, through which the respectively used lifting means (hoisting sling or hoisting strap) is drawn.

Additionally, a coupling opening is generally formed in the hoist which is positioned in the region of the top of the attachment means that rises above the slit. The hook of a crane, for example, can engage in the coupling opening in order to lift the attachment means using the hoisting strap and the pipe section resting therein.

Although the conventional attachment means described above have proven themselves in practice, they do have various disadvantages in terms of production and cost. For instance, the known attachment means generally need to be configured as forged pieces with a simple design in order to have sufficient load bearing capacity for transporting heavy weights. Moreover, it is necessary in many cases, due to the heavy loads to be moved which consequently apply high loads on the attachment means, to divide the slit receiving the lifting means using a bar which supports the contact section of the attachment means receiving the load delimiting the slit in the direction of the load to be moved. This leads either to two lifting means in the form of a sling or strap having to be fitted into the attachment means or specially manufactured lifting means having to be used which is divided accordingly in its region assigned to the slit.

A further disadvantage of the known attachment means also increasing the costs of known attachments means of the type described above consists in the fact that during production, the respective lifting means first has to be inserted into the slit with loose ends. The loose ends then need to be stitched together to form a strap for carrying the load. Since this work generally has to be done by hand, this represents a considerable physical imposition on the person doing the stitching in addition to a large number of costly processes.

SUMMARY OF THE INVENTION

Against the background of the prior art explained above, one problem to be solved by the invention is that of creating attachment means for lifting heavy, particularly large volume, cylindrical loads that is easy to use, can be produced cost-effectively and has sufficient load bearing capacity with a low material requirement. Moreover, a correspondingly configured apparatus for lifting heavy, particularly large volume, cylindrical loads is provided.

The invention has solved this problem in relation to the attachment means for lifting heavy loads in that it has the features indicated herein.

With regard to the apparatus for lifting heavy loads, a solution for the problem indicated above is provided by an apparatus described herewith.

Advantageous embodiments of the present invention are explained in detail below as per the general inventive concept.

An attachment means for lifting heavy loads using lifting means in the form of a sling or strap comprises a contact part and a bracing part for bracing the contact part. The contact part has a contact section, the length of which, measured in a longitudinal direction of the attachment means, corresponds at least to the width of the lifting means. The contact part also has a contact surface on which the lifting means rests during practical use. Moreover, the contact part has two attachment sections, one of which is integrally shaped in each case on one of the ends of the contact section. The respective attachment sections serve during practical use to attach a hoist, via which the attachment means is connected to a hoisting apparatus, such as a crane for example.

According to the invention, the bracing part for bracing the contact part of an attachment means is fixedly connected to the contact part and extends at least over the length of the contact section of the contact part. In this manner, the contact part is effectively supported in the region in which it would warp most during practical use under the then effective load.

The specific arrangement of the bracing part in this position allows both the contact part and the bracing part to be dimensioned such that maximum loading capacity is achieved with minimal material requirement and weight. The contact part can be easily configured such that its contact surface has a concave, rounded shape for careful support without sharp edges or abrupt transitions of the lifting means in the form of a sling or strap provided for lifting the load.

An advantage of the attachment means in terms of practical use and cost-effective manufacture is that it is configured such that the hoisting apparatus used (crane, tractor, hoist etc.) is no longer connected via a direct and inseparable coupling member connected to the attachment means, such as a hook, shackle, lug or via an opening formed into the attachment means, but that an additional hoist is used here. The attachment sections provided for coupling the hoist to the attachment means protrude laterally at the ends of the contact section such that the respective hoist can be slid onto them after the attachment means has been manufactured.

For a coupling of the attachment means to a hoisting apparatus, all hoists, such as round slings and chains, equipped with lifting straps that are provided with loops for receiving the attachment sections are suitable, which firstly can be placed around the attachment sections of the attachment means provided for this purpose such that the attachment means hangs in them using its attachment sections during practical use, and secondly, are suitable for connection to the respective hoisting apparatus using a hook, shackle, lug etc.

An apparatus for lifting a heavy load includes attachment means according to example embodiments and a hoist provided for coupling of the attachment means to a hoisting apparatus, said hoist is looped around the attachment sections of the contact part. Round slings, which are used to lift and move rod-shaped cylindrical components, have proven to be hoists that are particularly easy to use in practice, are highly resilient and have become reliable in tough, practical working conditions.

A further advantage of an attachment means according to example embodiments from a manufacturing perspective is that before the hoist provided for coupling to the respective hoisting apparatus is attached thereto, it can be inserted into the openings of a loop serving as lifting means in the style of a mandrel, where said loop has been prefabricated from a sufficiently resilient belt or strap material separately from the attachment means. Thus each of the parts of a lifting apparatus as per the invention required for practical lifting tasks can be prefabricated and stored separately from one another. This allows not only cost-effective and straightforward manufacture, but also simple adjustment of the individual components of the apparatus to the respective transportation or lifting task. Also in the event of wear and tear, the individual parts of a lifting apparatus can be replaced separately from one another in a straightforward manner.

It is possible to configure a holding attachment for coupling the hoist to the attachment means on the attachment sections of the contact part by applying or configuring a shaped part there. A captive connection of the individual components of a lifting apparatus according to example embodiments can, however, also be supported as per an advantageous embodiment of the invention in a particularly simple and cost-effective way in that the bracing part has an end section at each of its ends, said section extends at a distance from the attachment sections of the contact part in a longitudinal direction of the attachment means and consequently the end sections of the bracing part delimit a holding attachment with the respectively assigned attachment part into which the respective hoist can be inserted during practical use.

The holding attachments optionally provided in the manner described above in the region of the ends of the attachment means can be formed in the style of lugs or openings which are surrounded by a closed rim and consequently the respective hoist can be threaded through them for practical use. The coupling of the hoist to the attachment means is particularly easy, however, if the holding attachments are configured to be laterally open in the style of slits so that the section of the hoist assigned to the respective holding attachment can be easily slid onto the respective attachment section of the contact part. In order firstly to be able to insert the hoist easily into the holding attachments configured in this manner, and secondly, ensure a defined guiding of the sections of the hoist resting in the holding attachment during practical use, the distance between the end sections of the bracing part and the assigned attachment section of the contact part can be restricted such that said distance is only greater by a specific, slight overdimension in relation to the maximum thickness of the hoist provided for attachment of the attachment means to a lifting apparatus.

For attachment means or lifting apparatuses according to example embodiments, which are often used for the same purpose and are equipped with the lateral slit-shaped holding attachment in the manner described above, it may be advisable for the attachment means to be provided with securing devices with which the holding attachments configured between the attachment sections of the contact part and the end sections of the bracing part assigned thereto can be locked in the region of the free ends of the attachment means. With the help of the respective securing devices, the holding attachments can be locked after the assigned section of the hoist is slid onto the respective attachment section and consequently an unintentional loosening of the hoist from the respective attachment section is reliably prevented. Whilst the respective securing means can be detachably connected to the attachment means as per the invention, the hoist can still be easily replaced where required. Dowels, split pins, screws, springs or similar, which, are for example attached to a holding attachment provided on the attachment means and bridge the insert opening of the holding fixtures, are suitable as securing devices.

The otherwise potential risk of excess wear and tear on the hoist or the attachment means itself particularly in the region of the transition between the attachment sections and the contact section of the contact part can be counteracted by configuring a broadened contact surface in the region of the transition between the contact section and the attachment section connected thereto, on which broadened contact surface the hoist attached to the attachment sections rests during practical use. This also reliably prevents the hoist from clamping the lifting means resting on the contact section provided for coupling to the respective load to be lifted.

The attachment surfaces optionally provided in this manner are advantageously arranged inclined towards one another such that their intended extensions intersect at the point where the hoist attached to the attachment sections during practical use weighs on the respective lifting apparatus. This will guarantee optimum bracing of the hoist when under the action of a load in terms of minimising wear and tear.

Due to its simple basic design, an attachment means according to example embodiments is suitable for single piece manufacture, in particular forging. A cost-effective, particularly for producing smaller quantities, particularly advantageous embodiment of the invention, makes the provision, however, that at least the contact part and the bracing part of the attachment means are prefabricated as profiled parts and that such profiled parts are then integrally joined, in particular are welded, to the finished attachment means. Naturally, other components, such as for example moulded parts, which are required to configure the optionally provided attachment surfaces, can also be prefabricated from an appropriate material and integrally joined to the other parts of the attachment means. In particular, cylindrical bars made of steel or another metal, for example, are suitable as base material for the contact part, where the diameter of said bars is selected such that the lifting means resting on the contact section during practical use is guided over a sufficiently large radius. The bracing section can on the other hand be cut from a flat material of sufficient strength.

DETAILED DESCRIPTION OF THE INVENTION

An attachment means 1 as a welded construction comprises a separate cylindrical contact part 2 made from a steel rod or pipe, a bracing part 3 cut from a flat steel material of sufficient strength and two guide plates 4, 5 also cut from a flat steel material.

Figure 1:
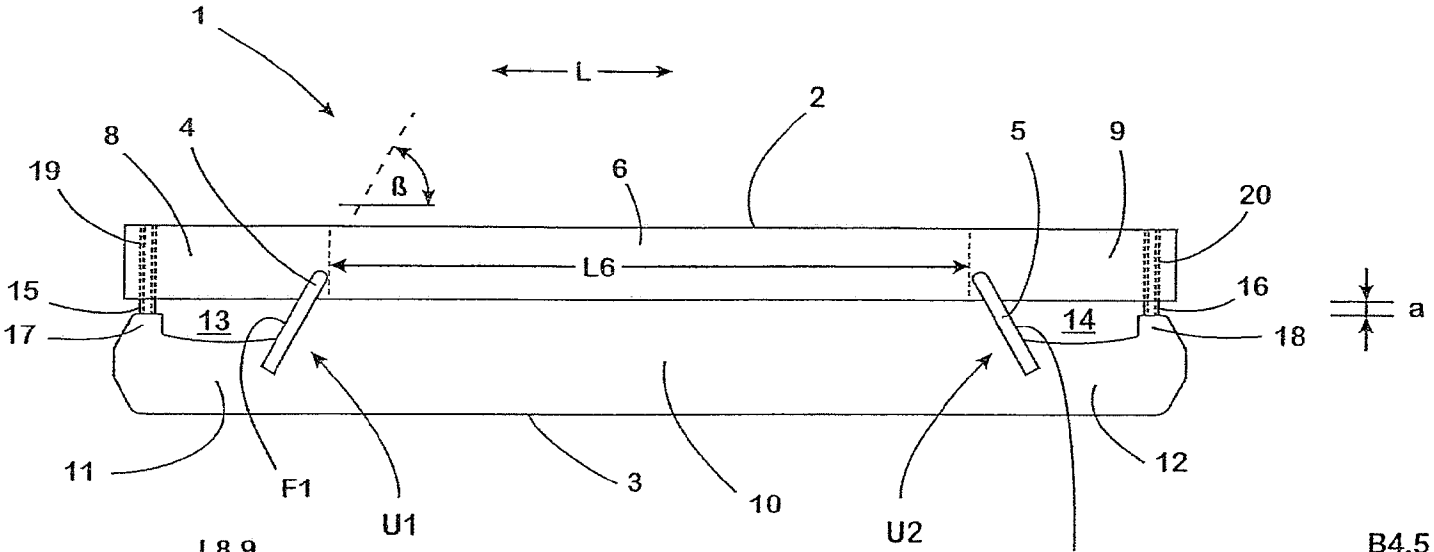
FIG. 1 shows a side view of an attachment means.
Figure 2:
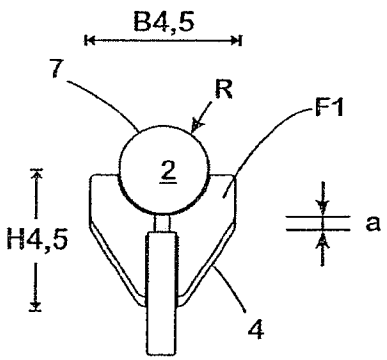
FIG. 2 shows a front view of the attachment means.
Figure 3:
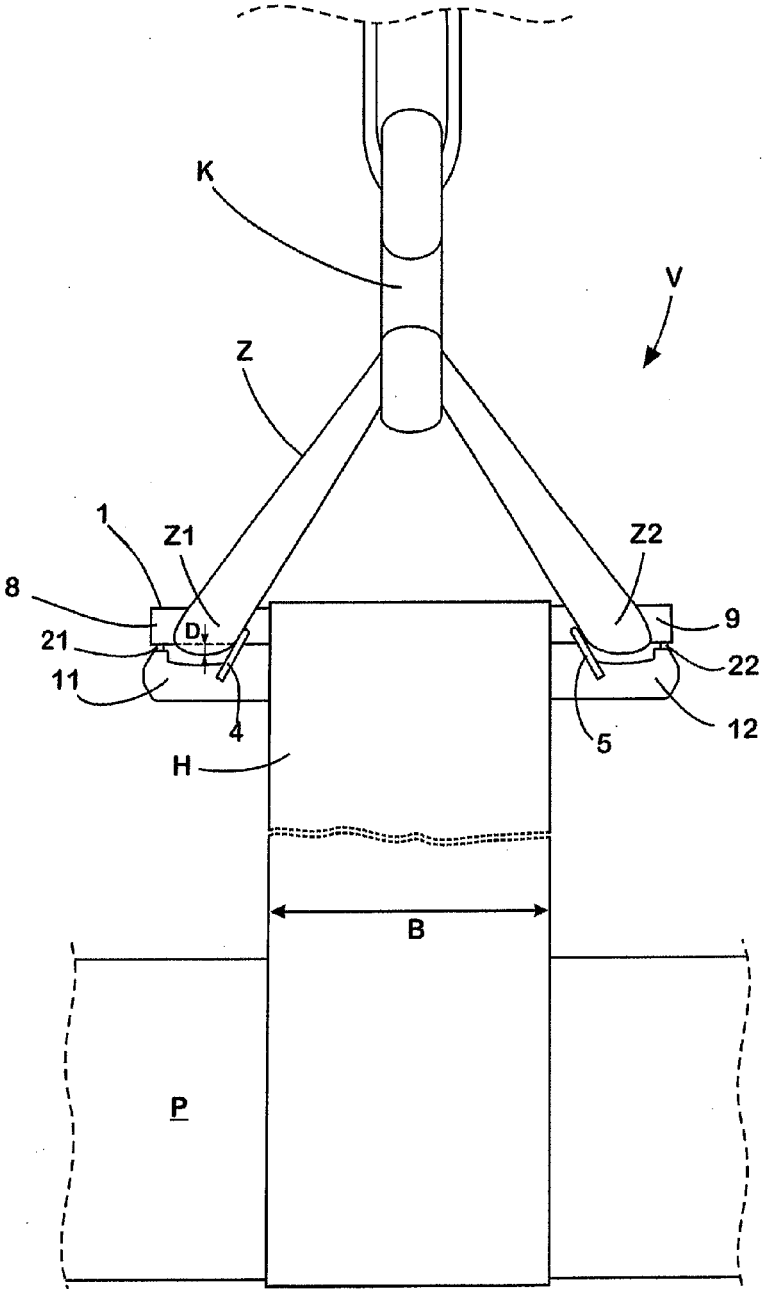
FIG. 3 shows a side view of an apparatus for lifting a pipeline section.

The contact part 2 has a central contact section 6, which extends in a longitudinal direction L of the attachment means 1 and the length of which L6 is a specific, slight overdimension in relation to the maximum width BH of the lifting means H configured as a conventional hoisting sling loop which is provided in the apparatus V shown in FIG. 3 for lifting the pipeline section P. The diameter of the overall uniformly cylindrical contact part 2 is selected such that the lifting means H is guided over a radius R during practical use that is large enough to prevent local loads in the lifting means H that are too heavy over the contact surface 7 formed on the top of the attachment section 6.

An attachment section 8, 9 projecting laterally as an extension of the attachment section 6 is integrally shaped at the ends of the attachment section 6 of the contact part 2. The length L8, 9 of the attachment sections 8, 9 is selected at least such that a sufficiently wide attachment surface is available for the section of a hoist Z configured as a round sling assigned to the respective attachment section 8, 9.

The bracing part 3 serves to brace the contact part 2 and has a central section 10 which is oriented parallel to the longitudinal axis of the contact part 2 and extends along the length L6 of the contact section 6. An end section 11, 12 is configured in each case at the ends of the central section 10 of the bracing part 2 which extends in a longitudinal direction L of the attachment means 1 at a distance a from the attachment sections 8,9 of the contact part 2. In this manner, the end sections 11, 12 of the bracing part 3 with the attachment section 8,9 assigned respectively thereto in each case delimit a slit-shaped, laterally open holding attachment 13, 14 into which the respectively assigned section Z1, Z2 of the hoist Z is inserted when assembling the apparatus V.

The distance a between the end sections 11, 12 and the respectively assigned attachment section 8, 9, is adjusted in the process according to the thickness of the attached section Z1, Z2 of the hoist Z such that hoist Z can be easily slid onto the respective attachment section 8, 9 and at the same time sufficient manoeuvrability of the hoist Z in the respective holding attachment 13, 14 is guaranteed. In the process, in the region of the respective lateral slit opening 15, 16 of the holding attachments 13, 14, a hook-shaped protruding heel 17, 18 is provided in the direction of the respectively assigned attachment section 8, 9 as a result of which the respective slit opening 15, 16 is narrowed there such that an unintentional sliding down of the hoist Z from the respective stop heel is prevented.

One of the guide plates 4, 5 is arranged in the regions of the transitions U1, U2 from the central section 10 of the bracing part 3 to the end sections 11, 12 thereof. The guide plates 4, 5 are oriented diagonally to the longitudinal extension L of the attachment means 1 and inclined towards one another at an angle β, which corresponds to the angle at which the sections Z1, Z2 coupled to the respective attachment section 8,9 converge when under the action of a load on the hook K of a crane used as a lifting apparatus here but not shown. In this manner the front surfaces of the guide plates 4,5 facing away from each other and facing towards the respective section Z1, Z2 of the hoist Z, each form a contact surface F1, F2 onto which the respective section Z1, Z2 of the hoist Z is guided when under the action of a load. The width B4, 5 of the contact surfaces F1, F2 provided on the guide plates 4, 5 is selected such that the assigned sections Z1, Z2 of the hoist Z are securely supported there over their entire width. At the same time, the height H4, 5 of the guide plates 4, 5 is dimensioned such that the guide plates 4, 5 extend in a ready assembled state from the bracing part 3 up to just over half the diameter of the attachment section 2. The smallest distance of the guide plates 4, 5 is selected such that the lifting means H moves freely between them during practical use.

In the vicinity of their free ends, a threaded opening 19, 20 is formed in each of the attachment sections 8, 9 which leads through the respective attachment section 8, 9 and is oriented such that its longitudinal axis meets the respective heel 17, 18 of the assigned end section 11, 12.

The threaded openings 19, 20 each serve as holding attachments for a fastening bolt 21, 22, which, after each assigned section Z1, Z2 has been slid on to lock the slit opening 15, 16 in the respective holding attachment, is screwed into the threaded opening 19, 20 until it reaches the heel 17, 18 assigned thereto. In this manner, the holding attachments 13,14 can be locked such that the hoist Z is captively held on the attachment means.

To assemble the apparatus, firstly the attachment means 1 is moved through the opening surrounded by the loop-shaped lifting means H. Then the sections Z1, Z2 of the hoist Z configured as a round sling are slipped onto each assigned attachment section 8, 9 until they sit in the holding attachments 13, 14. The fastening bolts 21, 22 are then screwed in to close off the holding attachments 13, 14 at the side.

The lifting means H can now be placed around the pipeline section P to be lifted. The hoist Z is then hung in the hook K of the crane used here as the lifting apparatus.

The invention claimed is:

1. An attachment device for lifting heavy loads by a lifting device in the form of a sling or strap,
- having a contact part,
- which has a contact section
- with a length, measured in the longitudinal direction of the attachment device which corresponds to at least a width of the lifting device, and
- having a contact surface on which the lifting device rests during practical use, and
- two attachment sections,
- of which in each case one is integrally formed on one of the ends of the contact section, and
- which are provided for attaching a hoist for coupling the attachment device to a lifting apparatus, and
- a bracing part for bracing the contact part,
- which is fixedly connected to the contact part and extends at least over the length of the contact section of the contact part
- wherein the bracing part has an end section at each of the ends thereof, which extends in the longitudinal direction of the attachment device at a distance from the two attachment sections of the contact part, wherein the end sections of the bracing part with the attachment sections, respectively assigned thereto, each delimit a holding attachment into which the respective hoist can be inserted during practical use, and wherein each holding attachment is slit-shaped and laterally open.

2. The attachment device according to claim 1, wherein a distance between the end sections of the bracing part and the respectively assigned attachment sections of the contact part is a specific, slight over dimension in relation to the maximum thickness of the hoist to be slid onto the two attachment sections.

3. The attachment device according to claim 2, wherein securing devices are provided with which holding attachments can be locked at the side in the region of the free ends of the attachment device.

4. The attachment device according to claim 1, wherein a broadened contact surface is configured in a region of transitions between the broadened contact surface and the two attachment sections connected thereto in each case or in a transition region between a central section of the bracing part and in each case the end sections thereof, on which contact surface the hoist attached to the two attachment sections rests during practical use.

5. The attachment device according to claim 4, wherein the broadened contact surfaces are arranged inclined towards one another such that their intended extensions intersect at a point where the hoist attached to the two attachment sections weighs on the respective lifting apparatus during practical use.

6. The attachment device according to claim 1, wherein said attachment device is configured as a single piece.

7. The attachment device according to claim 1, wherein the contact part has a basic cylindrical shape.

8. The attachment device according to claim 1, wherein the bracing part is cut from a flat product.

9. An apparatus for lifting a heavy load comprising the attachment device according to claim 1 and the hoist for coupling said attachment device to a lifting apparatus which is looped around the two attachment sections of the contact part.

10. The apparatus according to claim 9, wherein the hoist is a rounded sling.

11. The apparatus according to claim 1, wherein at least the contact part and the bracing part are prefabricated as profiled parts and are welded together.

* * * * *